US005350344A

United States Patent [19]

Kissel

[11] Patent Number: 5,350,344

[45] Date of Patent: Sep. 27, 1994

[54] EXERCISE MACHINE

[76] Inventor: Robert M. Kissel, 757A Windy Ridge, Manchester, Mo. 63021

[21] Appl. No.: 1,041

[22] Filed: Jan. 6, 1993

[51] Int. Cl.[5] ..... A63B 21/062

[52] U.S. Cl. ..... 482/98; 482/1; 482/5; 310/15

[58] Field of Search ..... 482/1-9, 482/98-103, 133-137; 310/15, 30

[56] References Cited

U.S. PATENT DOCUMENTS

| | | | |
|---|---|---|---|
| 3,635,472 | 1/1972 | Marltan | 482/101 |
| 3,971,555 | 7/1976 | Mahnke | 482/98 |
| 4,140,932 | 2/1979 | Wohlert | 310/15 |
| 4,363,980 | 12/1982 | Petersen | 310/15 |
| 4,610,449 | 9/1986 | Diercks, Jr. | 482/98 |
| 4,709,176 | 11/1987 | Ridley et al. | 310/30 X |
| 4,746,113 | 5/1988 | Kissel | 482/99 |
| 4,811,946 | 3/1989 | Pelczar | 482/5 |
| 5,037,089 | 8/1991 | Spagnuolo et al. | 482/137 X |

*Primary Examiner*—Robert Bahr
*Attorney, Agent, or Firm*—Polster, Lieder, Woodruff & Lucchesi

[57] ABSTRACT

An exercise machine includes a weight stack with a plurality of separate weights and a lift bar for vertical movement with the stack. A pin assembly removably secures a desired portion of the weight stack to the lift bar for vertical movement therewith so that the total weight carried by the lift bar is determined by the portion of the weight stack removably secured to the lift bar by the pin assembly. The pin assembly includes at least one pin operated by a two-position or double action actuator, each pin being movable by its actuator over a predetermined stroke. Each actuator includes a first device for positively moving the pin to an extended position to removably secure a portion of the weight stack to the lift bar and a second device for positively moving the pin to a retracted position in which the corresponding of the weight stack is free of the lift bar.

5 Claims, 3 Drawing Sheets

EXERCISE MACHINE

BACKGROUND OF THE INVENTION

This invention relates to exercise equipment and more particularly to varying the number of weights in a weight stack.

Inventor's prior U.S. Pat. No. 4,746,113 discloses exercise equipment which automatically provides a changing workload to the user. The equipment described therein was designed to solve the inherent mismatch between the ever changing strength of the user and the resistance against which he or she is exercising.

Such exercise equipment may also be used in a non-automatic manner, but in any event it is desirable that the number of weights in the weight stack be varied without the user stopping the exercise temporarily to change the weight. Although the solenoids disclosed in said aforementioned patent perform this weight changing function, they could be improved.

SUMMARY OF THE INVENTION

One object of the invention is to provide an exercise machine with an improved system of changing the weight in a weight stack.

Another object is to provide such a machine which accurately and efficiently changes the weights in a weight stack A third object is to provide such a machine which positively selects and positively deselects weights in a weight stack.

A fourth object is to provide such a machine with a weight selecting pin actuator that does not continuously require current in order to remain extended against the resistance of a spring (such as a solenoid), which as a result eliminates a constant humming noise.

A fifth object is to provide such a machine which minimizes the cost and weight of the weight selecting mechanism.

A sixth object is to provide such a machine in which the exact function is dictated by its design—to simply move the weight selecting pin through free air into an opening within 3/16" of the diameter of the pin rather than extend the pin to move something in its path.

A seventh object is to provide such a machine in which the amperage draw is brief and minimal and the machine is at rest except when the machine needs to extend or retract a weight selecting pin. Once a pin is extended or retracted, the pin actuator is turned off, thereby minimizing the current draw.

An eighth object is to provide such a machine which is extremely rugged and reliable.

A ninth object is to provide such a machine which minimizes the size of the weight selecting mechanism in order to be placed in between each plate which normally is 1" or less.

A tenth object is to provide a machine in which the pin actuators have improved performance over pull-type solenoids.

An eleventh object is to provide such a machine with a sensor which monitors the performance of each stroke, both extended and retracted strokes.

These and other objects will become apparent to those skilled in the art in light of the following disclosure and accompanying drawings.

Briefly, an exercise machine of the present invention includes a weight stack composed of a plurality of separate weights vertically disposed with respect to each other, a lift bar disposed for vertical movement with the stack, and a pin assembly for removably securing a desired portion of the weight stack to the lift bar for vertical movement therewith so that the total weight carried by the lift bar is determined by the portion of the weight stack removably secured to the lift bar by the pin assembly. The pin assembly includes at least one pin operated by an actuator, each pin being movable by its actuator over a predetermined stroke. The actuator includes first means for positively moving the pin to an extended position to removably secure a portion of the weight stack to the lift bar and second means for positively moving the pin to a retracted position in which the corresponding of the weight stack is free of the lift bar.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
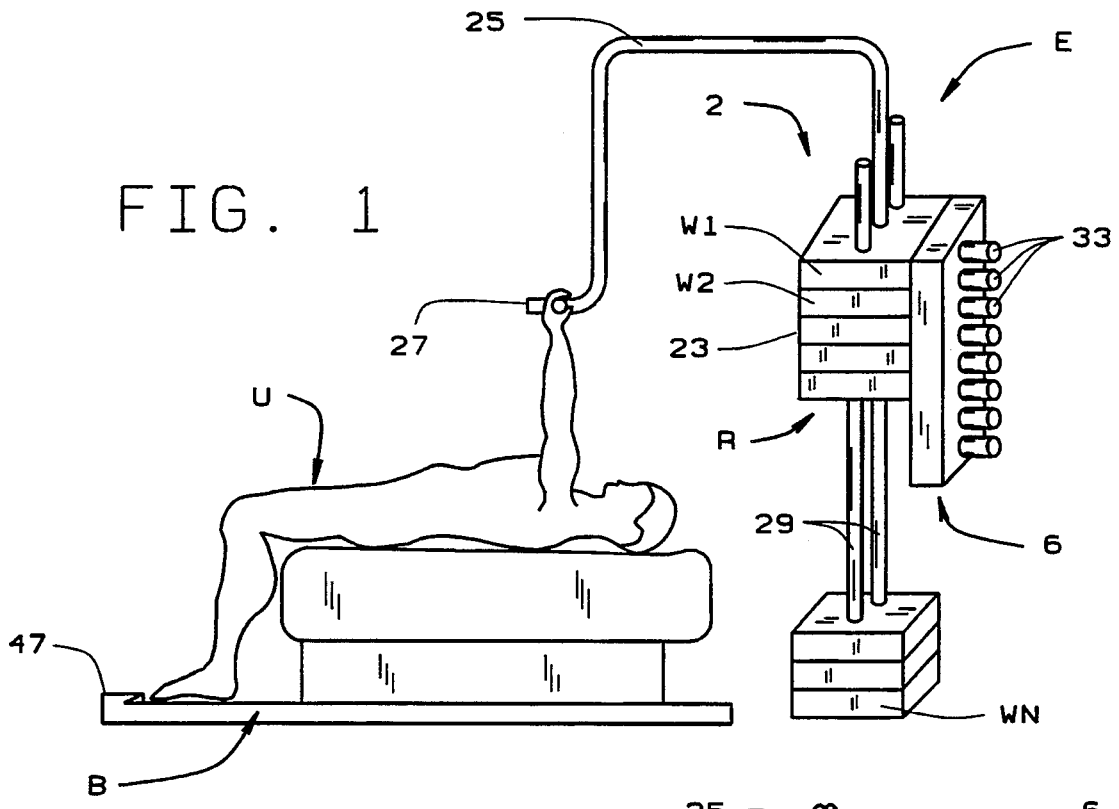
FIG. 1 is a perspective view of an exercise machine of the present invention.

Referring to FIG. 1, exercise machine E is shown which includes a weight varying mechanism 2 to vary the resistance against which a user U works. Machine E may include a computer (not shown) or other suitable circuitry for controlling the changing of the resistance, although the particular circuitry used is not a part of the present invention.

In this regard, reference should be made to U.S. Pat. Nos. 4,824,103 to Smidt; 4,746,113 to Kissel; 4,571,682 to Silverman et. al.; 4,170,225 to Criglar et. al.; 4,110,918 to James et. al.; and 3,916,876 to Freeman, the disclosures of which are hereby incorporated herein by reference.

Numerous resistance varying mechanisms 2 and resistance varying controls 6 are known in the art. Of special usefulness in connection with the present invention are electronic or electromagnetic resistance varying systems such as those shown in U.S. Pat. Nos. 4,828,257 to Dyer et. al.; 4,778,175 to Wucherpfenning et. al.; 4,765,613 to Voris; 4,750,738 to Dang; 4,518,163 to Bruder; and 4,261,562 to Flayell. The disclosures of these patents are hereby incorporated herein by reference.

Equipment E includes a plurality of resistance elements or weights W1-WN disposed vertically with respect to each other in a weight stack 23, as is well known in the art. During a work-out, the weight operatively in the weight stack is changed by a mechanism 6. Mechanism 6 is secured to the top of weight stack 23 carried by a lifting bar 25 which is mechanically secured as shown to a handlebar 27. As shown, stack 23 corresponds to the resistance varying mechanism 2. The user U grasps and pushes on the handlebar to lift stack 23 upwardly and then lowers it along a path defined by a pair of guide rails 29. Although guide rails 29 are shown for controlling the path of movement of stack 23, any conventional means for controlling the path of the stack may be included. As further shown, additional weights W may be individually secured to lifting bar 25 as desired to increase the weight of stack 23. Similarly, the weight of stack 23 may be reduced by eliminating one or more weights from the stack by suitable insertion and removal of pins 31. A pin inserted in one of the weights and the lifting bar causes the weight and each weight positioned above it in the stack to be lifted by the lifting bar while the remaining weights, are left behind, as is best illustrated in FIGS. 2 and 3.

Figure 2:
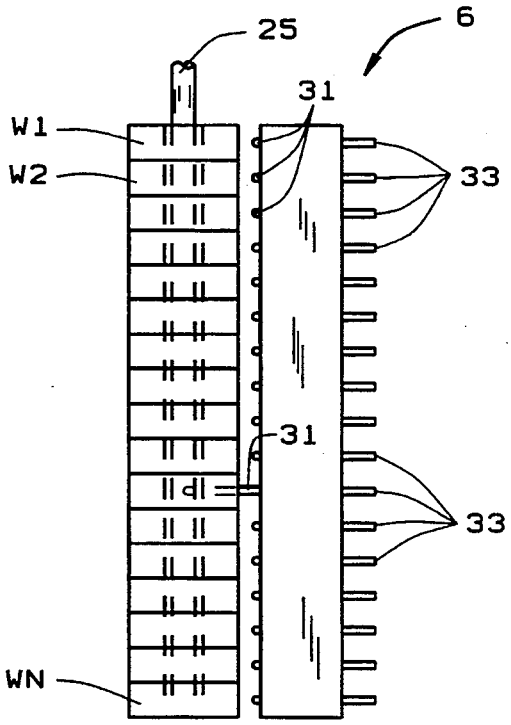
FIG. 2 is a side elevation of a portion of the machine of FIG. 1, illustrating the weight selecting mechanism of the present invention.
Figure 3:
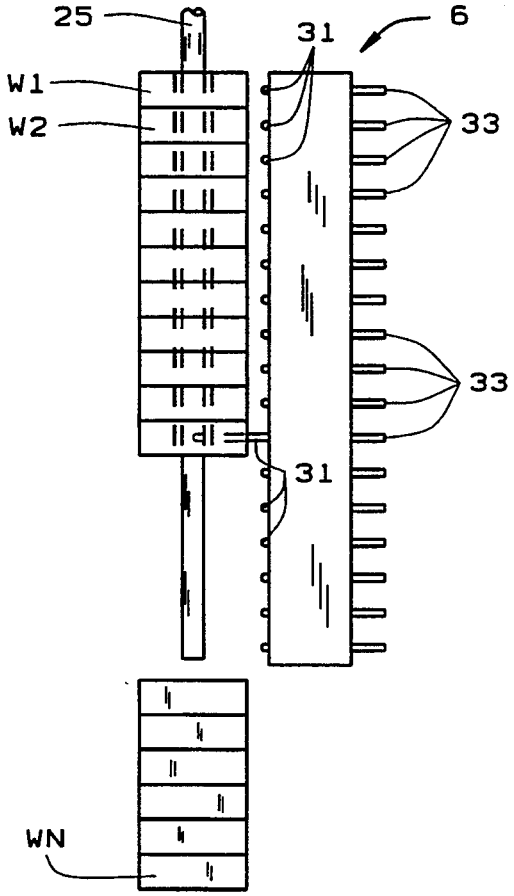
FIG. 3 is a view similar to FIG. 2 illustrating the weight stack in an elevated position.

As shown most clearly in FIGS. 2 and 3, the weight controlling mechanism 6 includes a plurality of pins 31 (one pin for each weight in stack 23 is shown) which are moved from retracted to extended positions and back by corresponding actuators 33.

Figure 4:
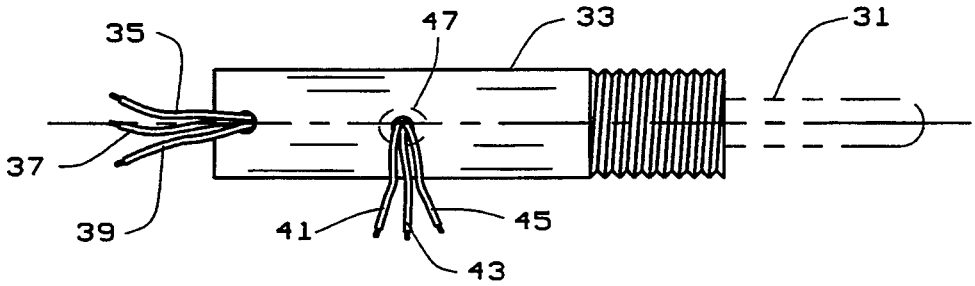
FIG. 4 is a side elevation of an actuator/pin assembly used in the exercise machine of FIG. 1.

Actuator 33 with pin 31 is shown in more detail in FIGS. 4 and following. It is preferred that actuator 33 be as short as possible. The actuator shown in FIG. 4 is, for example, four inches in length with the pin 31 withdrawn. When pin 31 is extended, the pin has an extended length of $1\frac{5}{8}''$, so that the ratio of the actuator length to pin throw is approximately 2.5:1. Pin 31 itself is approximately 0.3" in diameter and is made of a suitably strong material such as steel.

Three wires 35, 37, 39 exit from the rear of actuator 33 and are used to supply power to the actuator to positively move pin 31 to the extended position (shown in phantom in FIG. 4) and to positively move pin 31 to the retracted position inside actuator 33. An additional three wires 41, 43, 45 are used in combination with a sensor 47 used to detect whether the pin is in the extended or retracted position. The particular type of sensor used may vary without departing from the scope of the present invention, although Hall effect sensors or photoelectric sensors could easily be used.

Figure 5:
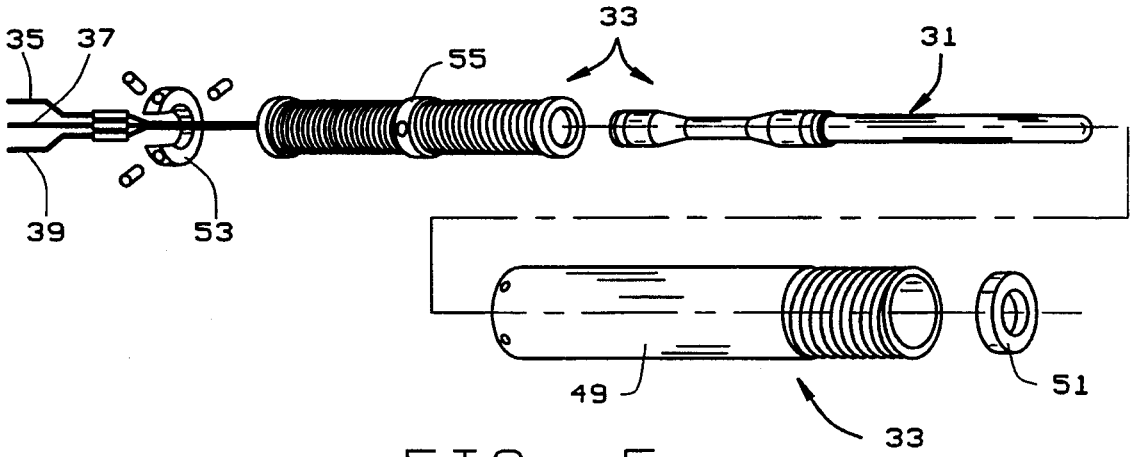
FIG. 5 is an exploded view of the actuator/pin assembly of FIG. 4.

Turning to FIG. 5, actuator 33 is seen to include a case 49 in which the remainder of the actuator is disposed, a pair of retaining rings 51, 53 used to mechanical secure the various parts of the actuator inside case 49, and a coil wound bobbin 55. When assembled, pin 31 is disposed at least partially inside bobbin 55 so that the passage of electrical current through the bobbin coils will exert force on the pin.

Figure 6:
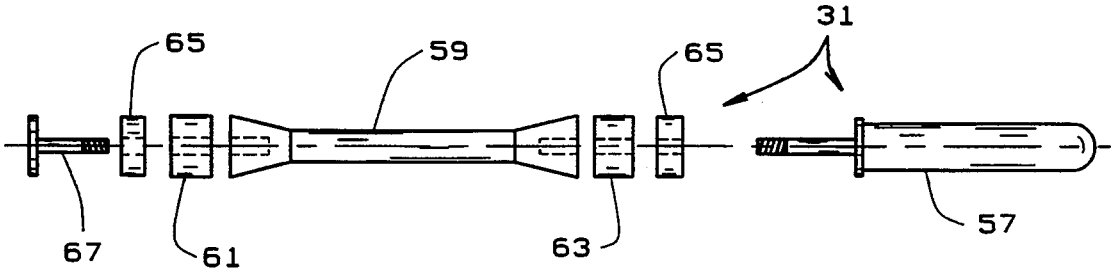
FIG. 6 is an exploded view of the pin shown in the actuator/pin assembly of FIG. 4.

Pin 31 (see FIG. 6) is also a multi-part device which includes not only the end portion 57 which is visible in FIGS. 2 and 3, but also numerous other parts including a pin center portion 59 made of a magnetic flux carrying material such as iron. Pin center portion 59 has mounted at each end magnets 61, 63, which are preferably strong rare-earth magnets. A pair of washers 65 and a pin end screw 67 are also provided to complete the assembly of pin 31.

Figure 7:
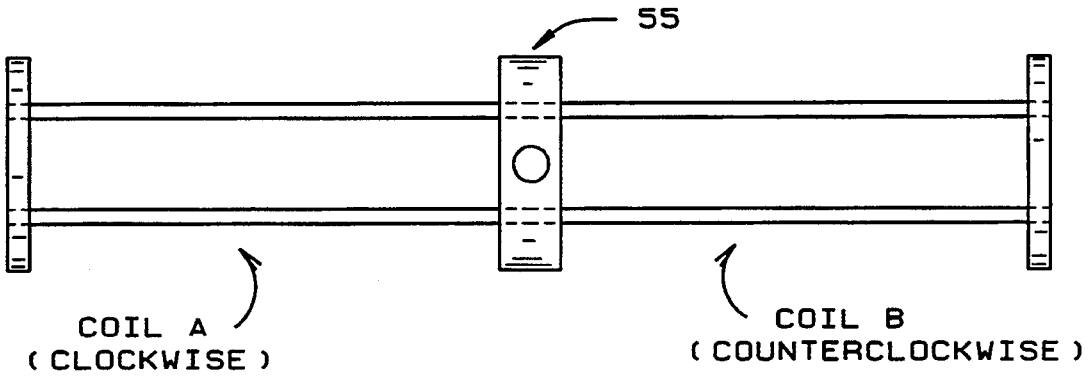
FIG. 7 is a side elevation of a coil bobbin used in the actuator/pin assembly of FIG. 4.

Turning to FIG. 7, bobbin 55 is shown with the spaces indicated for two separate coils "A" and "B". Both coils are bi-filar wound, coil A being wound in the clockwise sense with 200 turns of #24 AWG wire in five layers and coil B being identical, but wound in the counterclockwise sense. Application of power to coil A results in the pin being moved in, while application of power to coil B results in the pin being moved out. Only a brief pulse, on the order of 1/10th of a second, is needed to move the pin.

Figure 8:
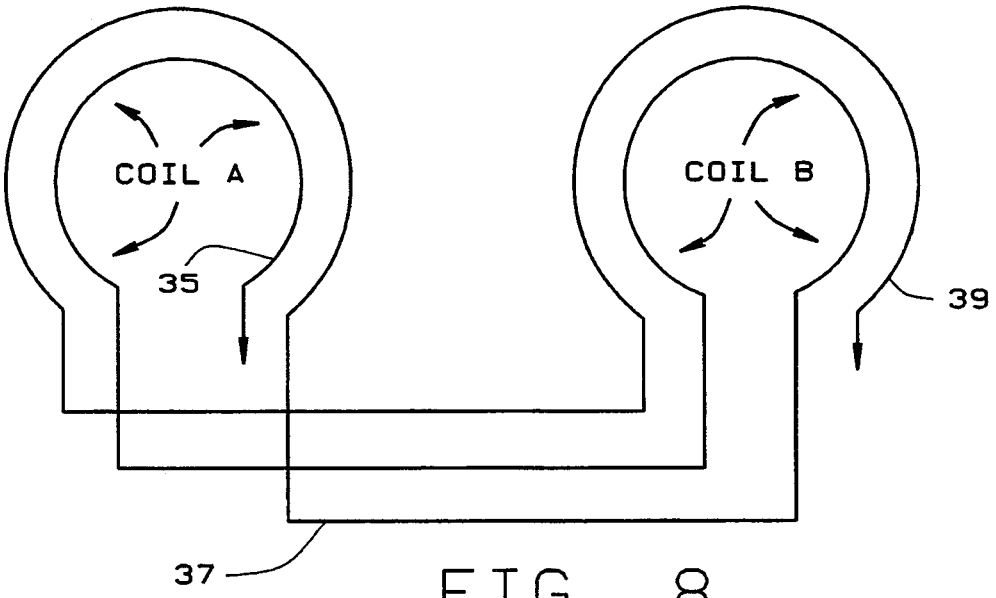
FIG. 8 is a schematic illustrating the coil connections used with the coil bobbin of FIG. 7.

As can be seen in FIG. 8, coils A and B are in series, connected by wire 37. The bi-filar continuous design allows for use of half as many transistors and driving sources as single Filar coil winding. The bi-filar design requires only two transistors, one to drive the pin in and one to drive to the pin out. Single windings, on the other hand, require four transistors. My bi-filar design allows for the pin to be pushed in and pulled out by simply reversing the current flow.

Thus, the present invention discloses structure for positively moving the pins to both the extended and retracted positions. Although this is done electrically in the preferred embodiment, the present invention is not so limited.

Figure 9:
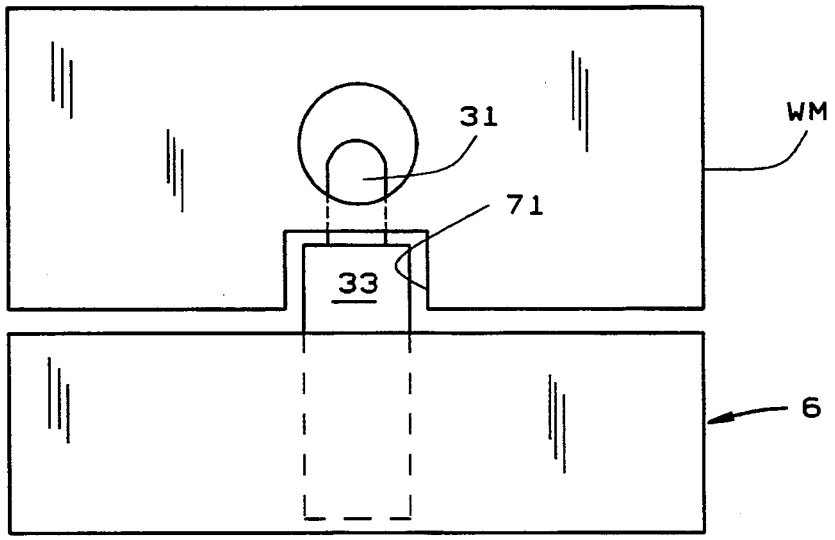
FIG. 9 is a top plan view illustrating a modified weight shape and actuator/pin assembly which reduces the overall width of the weight stack/selector assembly.

Turning to FIG. 9, there is shown a modification of the previously described invention. In this modification, each weight WM in the weight stack (or a number of adjacent weights) are similar to conventional weights in that they are generally rectangular. However, the weights have a notch 71 centrally located therein so that the actuator 33 may be disposed at least partially in the weight stack. As a result, the required throw of pin 31 is drastically reduced, and the entire length of actuator 33 may be reduced correspondingly- It should be understood that actuators 33 are movable vertically in the groove formed by notches 71 in the weights of the weight stack.

In view of the above, it will be seen that the various objects and features of the invention are achieved and other advantageous results obtained. As various changes could be made in the above constructions and methods without departing from the scope of the invention, it is intended that all matter contained in the above description or shown in the accompanying drawings shall be interpreted as illustrative and not in a limiting sense.

What is claimed is:

1. An exercise machine comprising:

a weight stack composed of a plurality of separate weights vertically disposed with respect to each other;

a lift bar disposed for vertical movement with the stack; and pin means for removably securing a desired portion of the weight stack to the lift bar for vertical movement therewith, whereby the total weight carried by the lift bar is determined by the portion of the weight stack removably secured to the lift bar by the pin means;

said pin means including at least one pin operated by an actuator, said pin being movable by its actuator over a predetermined stroke, said actuator including first means for positively moving the pin to an extended position to removably secure a portion of the weight stack to the lift bar, said actuator first means including a first magnet mechanically secured to move with the pin in a first direction upon application of an electrical current to said first coil, and first electrically operable means for positively moving the pin to the extended position, said first electrically operable means having a first coil longitudinally disposed with respect to the longitudinal axis of the pin;

said actuator means further including second means for positively moving the pin to a retracted position in which the corresponding portion of the weight stack is free of the lift bar, the actuator second means including a second magnet mechanically secured to move with the pin in a second direction.

2. An exercise machine comprising: a weight stack composed of a plurality of separate weights vertically disposed with respect to each other;

a lift bar disposed for vertical movement with the stack; and, pin means for removably securing a desired portion of the weight stack to the lift bar for vertical movement therewith, whereby the total weight carried by the lift bar is determined by the portion of the weight stack removably secured to the lift bar by the pin means;

said pin means including at least one pin operated by an actuator, said pin being movable by its actuator over a predetermined stroke, said actuator including first means for positively moving the pin to an extended position to removably secure a portion of the weight stack to the lift bar, the actuator first means including first electrically operable means for positively moving the pin to the extended position, said actuator means further including second means for positively moving the pin to a retracted position in which the corresponding portion of the weight stack is free of the lift bar, the actuator second means including second electrically operable means for positively moving the pine to retracted position.

3. An exercise machine comprising: a weight stack composed of a plurality of separate weights vertically disposed with respect to each other;

a lift bar disposed for vertical movement with the stack; and pin means for removably securing a desired portion of the weight stack to the lift bar for vertical movement therewith, whereby the total weight carried by the lift bar is determined by the portion of the weight stack removably secured to the lift bar by the pin means;

said pin means including at least one pin operated by an actuator, the actuator including a pair of longitudinally spaced magnets operatively connected to the pin and a pair of electrical coils disposed to operatively interact with the magnets to apply net force to the pin for positively moving the pin to an extended position to removably secure a portion of the weight stack to the lift bar, and for positively moving the pin to a retracted position in which the corresponding portion of the weight stack is free of the lift bar.

4. An exercise machine comprising:

a weight stack composed of a plurality of separate weights vertically disposed with respect to each other;

a lift bar disposed for vertical movement with the stack; and pin means for removably securing a desired portion of the weight stack to the lift bar for vertical movement therewith, whereby the total weight carried by the lift bar is determined by the portion of the weight stack removably secured to the lift bar by the pin means;

said pin means including at least one pin operated by an actuator, said pin being movably by its actuator over a predetermined stroke, said actuator including first means for positively moving the pin to an extended position to removably secure a portion of the weight stack to the lift bar, said first means for positively moving the pin to the extended position including an electrical coil wound in a first sense about the longitudinal axis of the pin, said actuator means further including second means for positively moving the pin to a retracted position in which the corresponding portion of the weight stack is free of the lift bar, the second means for positively moving the pin to the retracted position including a second electrical coil wound in the sense opposite to the first sense about the longitudinal axis of the pin.

5. The exercise machine of claim 4 wherein said first and second electrical coils are connected in series, said pin being extended or retracted by reversing the flow of current through said coils.

* * * * *

UNITED STATES PATENT AND TRADEMARK OFFICE

CERTIFICATE OF CORRECTION

| | | |
|---|---|---|
| PATENT NO. | : | 5,350,344 |
| DATED | : | September 27, 1994 |
| INVENTOR(S) | : | Robert M. Kissel |

It is certified that error appears in the above-indentified patent and that said Letters Patent is hereby corrected as shown below:

In Claims, Column 5, Line 36 delete "pine" and insert -- pin --

Signed and Sealed this

Fifteenth Day of November, 1994

*Attest:*

Bruce Lehman

BRUCE LEHMAN

*Attesting Officer*

*Commissioner of Patents and Trademarks*